US011448420B2

(12) United States Patent
Scholten et al.

(10) Patent No.: US 11,448,420 B2
(45) Date of Patent: Sep. 20, 2022

(54) AIR DUCT DAMPER

(71) Applicant: JOHNSON CONTROLS, INC., Milwaukee, WI (US)

(72) Inventors: Jean H. Scholten, Roswell, GA (US); Aurimas Aniulis, Atlanta, GA (US); Damon Bryan Smith, Alto, GA (US)

(73) Assignee: Johnson Controls, Inc., Milwaukee, WI (US)

( * ) Notice: Subject to any disclaimer, the term of this patent is extended or adjusted under 35 U.S.C. 154(b) by 178 days.

(21) Appl. No.: 16/251,016

(22) Filed: Jan. 17, 2019

(65) Prior Publication Data

US 2019/0219300 A1 Jul. 18, 2019

Related U.S. Application Data

(60) Provisional application No. 62/618,206, filed on Jan. 17, 2018.

(51) Int. Cl.
*F24F 13/10* (2006.01)
*F24F 13/14* (2006.01)
(Continued)

(52) U.S. Cl.
CPC ..... *F24F 13/105* (2013.01); *F24F 11/72* (2018.01); *F24F 13/1426* (2013.01);
(Continued)

(58) Field of Classification Search
CPC ..... F24F 13/105; F24F 11/72; F24F 13/1426; F24F 13/1486; F24F 2110/30;
(Continued)

(56) References Cited

U.S. PATENT DOCUMENTS 5,289,819 A 3/1994 Kroger et al.
5,458,148 A * 10/1995 Zelczer ..... F16K 1/221 137/15.17
(Continued)

FOREIGN PATENT DOCUMENTS

CN 201100426 Y 8/2008
CN 201184422 Y 1/2009
(Continued)

OTHER PUBLICATIONS

Doreing, Willi, EP2508815 Translation.pdf, "Device for influencing a flow of air", Oct. 2012, pp. 1-7.*
(Continued)

*Primary Examiner* — Avinash A Savani
*Assistant Examiner* — Ryan L Faulkner
(74) *Attorney, Agent, or Firm* — Foley & Lardner LLP

(57) ABSTRACT

An air damper assembly for an air duct having an interior wall and an exterior wall is provided. The air damper assembly includes a damper plate having a periphery and multiple teeth spaced at least partially around and extending from the periphery. The multiple teeth vary in length from a maximum to a minimum over a span of approximately 90 degrees around the periphery. The air damper assembly further includes an axle assembly fixedly coupled to the damper plate and rotatably coupled to the air duct. Rotation of the axle assembly causes the damper plate to rotate within the air duct between a fully open position and a fully closed position to increase or decrease a flow of fluid through the air duct.

23 Claims, 9 Drawing Sheets

(51) Int. Cl.
*F24F 11/72* (2018.01)
*F24F 110/30* (2018.01)
*F24F 110/40* (2018.01)

(52) U.S. Cl.
CPC .. *F24F 13/1486* (2013.01); *F24F 2013/1433* (2013.01); *F24F 2110/30* (2018.01); *F24F 2110/40* (2018.01)

(58) Field of Classification Search
CPC ..... F24F 2110/40; F24F 2013/1433; F24F 1/028; F24F 13/10; F24F 2203/1096; F24F 2221/52; F24F 13/18; F24F 13/1406
USPC ..... 454/333, 363, 94, 155, 219, 222, 264, 454/160
See application file for complete search history.

(56) References Cited

U.S. PATENT DOCUMENTS

| | | | | |
|---|---|---|---|---|
| 5,586,861 | A | 12/1996 | Berger | |
| 6,099,405 | A | 8/2000 | Cunningham, Jr. | |
| 6,192,922 | B1 * | 2/2001 | MacGibbon | F16K 3/085 137/486 |
| 7,392,826 | B2 | 7/2008 | Schub et al. | |
| 8,430,731 | B2 | 4/2013 | Bamberger | |
| 9,068,867 | B2 | 6/2015 | Ayers et al. | |
| 9,512,925 | B2 | 12/2016 | Shanker et al. | |
| 9,964,421 | B1 | 5/2018 | Buckley et al. | |
| 10,060,617 | B2 | 8/2018 | Horng et al. | |
| 10,174,847 | B2 | 1/2019 | Kabierschke et al. | |
| 10,260,537 | B2 | 4/2019 | Sawchuk | |
| 10,365,143 | B2 | 7/2019 | Sawchuk et al. | |
| 2004/0238046 | A1 | 12/2004 | Hoffman et al. | |
| 2016/0263967 | A1 | 9/2016 | Schaake | |
| 2017/0248237 | A1 | 8/2017 | Kabierschke et al. | |
| 2017/0254557 | A1 | 9/2017 | Chiu | |
| 2019/0219300 | A1 | 7/2019 | Scholten et al. | |

FOREIGN PATENT DOCUMENTS

| | | | | |
|---|---|---|---|---|
| CN | 101566237 | A | 10/2009 | |
| CN | 201688962 | U | 12/2010 | |
| CN | 103968145 | A | 8/2014 | |
| DE | 19717335 | A1 * | 11/1997 | B60H 1/00678 |
| EP | 1 783 409 | A1 | 5/2007 | |
| EP | 2 508 815 | A1 | 10/2012 | |
| FR | 2748308 | A1 | 11/1997 | |
| GB | 0 955 502 | A | 4/1964 | |
| JP | H01-311911 | A1 | 12/1989 | |
| JP | 5604093 | B2 | 10/2014 | |
| JP | 2018-076008 | A | 5/2018 | |
| WO | WO-2017/183365 | A1 | 10/2017 | |

OTHER PUBLICATIONS

Giordano, Giancarlo, DE19717335 Translation.pdf, "Pivot flap for controlling airflow", Nov. 1997, pp. 1-5.*
Notice of Allowance on U.S. Appl. No. 16/251,011 dated Apr. 22, 2020.
International Search Report and Written Opinion for International Application No. PCT/US2019/014085, dated Jun. 21, 2019, 20 pages.
Foreign Action other than Search Report on CN 201980018253.2, dated Jul. 27, 2021, 19 pages.
CN Office Action with Search Report on CN Appl. Ser. No. 201980018253.2 dated Apr. 8, 2022 (22 pages).

* cited by examiner

AIR DUCT DAMPER

CROSS-REFERENCE TO RELATED PATENT APPLICATIONS

This application claims the benefit of and priority to U.S. Provisional Patent Application No. 62/618,206 filed Jan. 17, 2018, the entire disclosure of which is incorporated by reference herein.

BACKGROUND

The present disclosure relates, in exemplary embodiments, to air duct dampers. More particularly, exemplary embodiments relate to air dampers with controllable resolution at lower flow rates.

Air dampers are mechanical valves used to permit, block, and control the flow of air in air ducts. Conventional dampers typically comprise a circular blade having an axle passing through the diameter of the blade, the ends of the axle being rotatingly mounted in the air duct wall. The diameter of the blade is marginally smaller than the diameter of the circular (or other cross-sectional shape) air duct so that, when the blade is in the closed position, all, or essentially all airflow is blocked, with no air passing between the edge of the blade and the air duct interior wall. A motor or other control mechanism is associated with the axle and, when actuated, rotates the axle, which causes the blade to rotate between an open, closed, or partially open position so as to permit controllable flow of air through the duct. A sensor or multiple sensors are disposed proximate to the damper for measuring airflow. The sensor is connected to a processor, which actuates the motor that controls the blade rotation, thus controlling the airflow required.

For many uses, conventional dampers are sufficient. However, air ducts used in certain critical room environments, for example, with exhaust valves, supply valves, room balance systems, and the like, require accurate control of airflow, particularly when the static pressure in the ductwork is high, tiny movements of the blade damper can result in significant changes in airflows. When a conventional damper blade is rotated from an initial closed position to a slightly open position, there is a tendency for a large volume of air to immediately be allowed to pass through the damper area, such volume being relatively uncontrollable. When the static pressure in the ductwork is high even tiny movements of the blade damper can result in significant changes in airflow. There is not enough control over the blade with the actuator to create movements small enough that proper control is maintained. It would be desirable to have a damper blade that would permit a more controllable flow of air at the nearly closed (or nearly open) position; i.e., at lower airflow requirements and more so at higher pressures.

SUMMARY

One implementation of the present disclosure is an air damper assembly for an air duct having an interior wall and an exterior wall. The air damper assembly includes a damper plate having a periphery and multiple teeth spaced at least partially around and extending from the periphery. The multiple teeth vary in length from a maximum to a minimum over a span of approximately 90 degrees around the periphery. The air damper assembly further includes an axle assembly fixedly coupled to the damper plate and rotatably coupled to the air duct. Rotation of the axle assembly causes the damper plate to rotate within the air duct between a fully open position and a fully closed position to increase or decrease a flow of fluid through the air duct.

In some embodiments, the damper plate includes a first airfoil member having multiple teeth made of a first material; and a second airfoil member having multiple teeth made of second material, the second material having a greater stiffness than the first material. In other embodiments, the damper plate further includes a third airfoil member having multiple teeth made of a third material, the third material having a greater stiffness than the second material.

In some embodiments, each of the teeth includes a resilient portion proximate the periphery and a flexible portion. The resilient portion has a greater stiffness than the flexible portion.

In some embodiments, the damper plate includes a gasket configured to contact the interior wall of the air duct when the damper plate is in the fully closed position.

In some embodiments, a portion of the multiple teeth contact the interior wall of the air duct when the damper plate is in the fully closed position. In some embodiments, a portion of the multiple teeth contact the interior wall of the air duct when the damper plate is in a partially closed position.

In some embodiments, a portion of the multiple teeth are fabricated from polytetrafluoroethylene (Teflon). In some embodiments, a portion of the multiple teeth are fabricated from a metal having a plastic coating.

In some embodiments, the axle assembly includes a first shaft member and a second shaft member. Each of the first shaft member and the second shaft member includes a slot configured to receive the damper plate.

In some embodiments, the axle assembly includes a shaft member configured to be fastened to the damper plate using a bracket component and multiple rivets.

In some embodiments, the air damper assembly includes a damper control assembly configured to drive rotation of the axle assembly. In other embodiments, the damper control assembly comprises a pressure sensor, a motor, and an actuator.

Another implementation of the present disclosure is a method for controlling a flow of fluid through an air duct. The method includes receiving a target airflow setpoint, receiving an airflow measurement from a pressure sensor, and generating a command to rotate a damper plate to a position setpoint between a fully open position and a fully closed position based at least in part on the target airflow setpoint and the airflow measurement. The damper plate has a periphery and multiple teeth spaced at least partially around and extending from the periphery. The multiple teeth vary in length from a maximum to a minimum over a span of approximately 90 degrees around the periphery. The method further includes driving the damper plate to the position setpoint.

In some embodiments, a portion of the multiple teeth contact the interior wall of the air duct when the damper plate is in the fully closed position. In some embodiments, a portion of the multiple teeth contact the interior wall of the air duct when the damper plate is in a partially closed position.

In some embodiments, the damper plate includes a first airfoil member having multiple teeth made of a first material; and a second airfoil member having multiple teeth made of second material, the second material having a greater stiffness than the first material. In other embodiments, the damper plate further includes a third airfoil member having multiple teeth made of a third material, the third material having a greater stiffness than the second material.

In some embodiments, each of the teeth includes a resilient portion proximate the periphery and a flexible portion. The resilient portion has a greater stiffness than the flexible portion.

Yet another implementation of the present disclosure is a method of providing an air damper assembly for an air duct having an interior wall and an exterior wall. The method includes providing an air damper assembly that includes a damper plate having a periphery and multiple teeth spaced at least partially around and extending from the periphery. The multiple teeth vary in length from a maximum to a minimum over a span of approximately 90 degrees around the periphery. The method further includes providing an axle assembly fixedly coupled to the damper plate and rotatably coupled to the air duct. Rotation of the axle assembly causes the damper plate to rotate within the air duct between a fully open position and a fully closed position to increase or decrease a flow of fluid through the air duct.

BRIEF DESCRIPTION OF THE DRAWINGS

The drawings disclose exemplary embodiments in which like reference characters designate the same or similar parts throughout the figures of which.

DETAILED DESCRIPTION

Unless otherwise indicated, the drawings are intended to be read (for example, cross-hatching, arrangement of parts, proportion, degree, or the like) together with the specification, and are to be considered a portion of the entire written description of this invention. As used in the following description, the terms "horizontal", "vertical", "left", "right", "up" and "down", "upper" and "lower" as well as adjectival and adverbial derivatives thereof (for example, "horizontally", "upwardly", or the like), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 1:
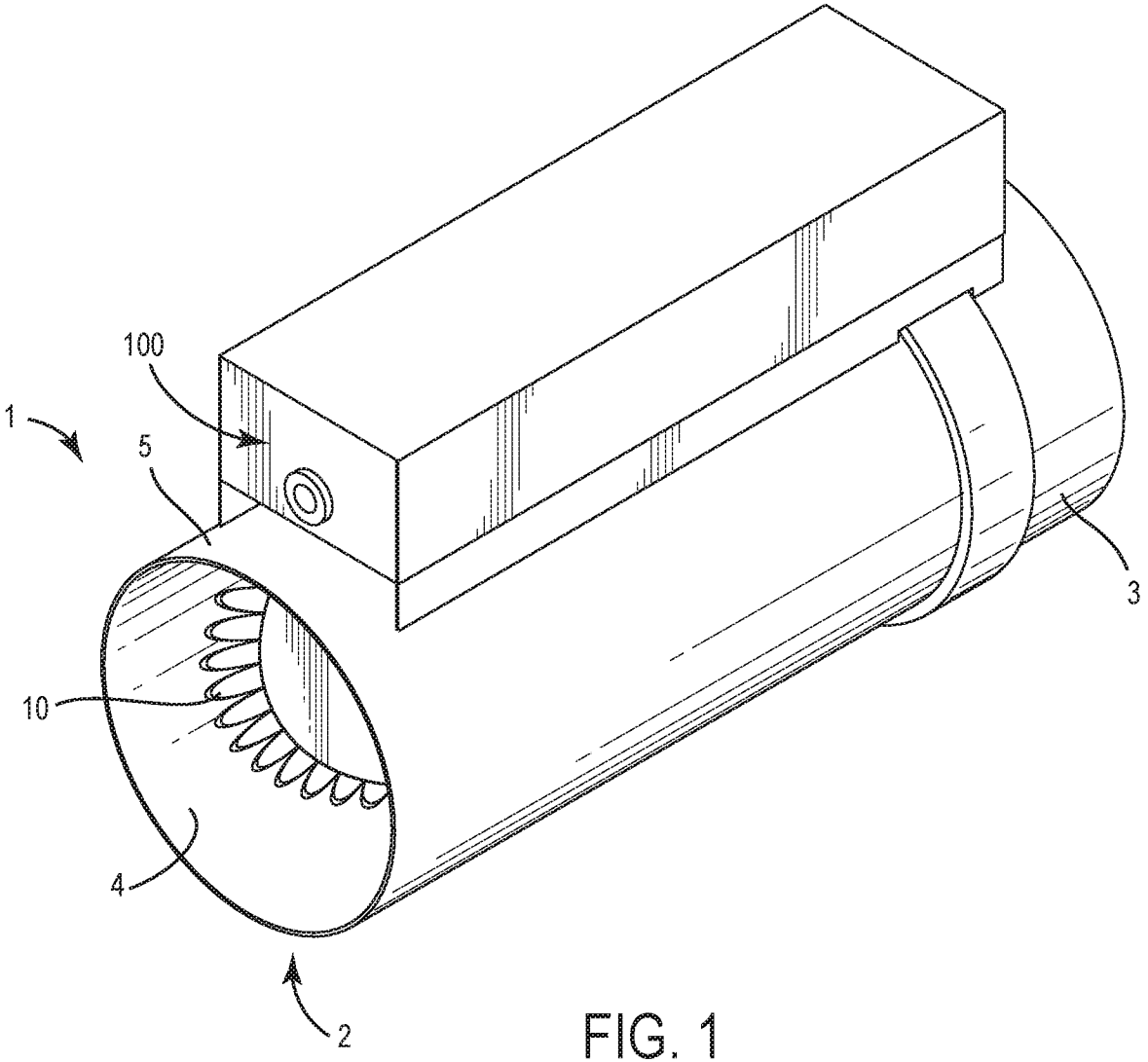
FIG. 1 is an isometric view of an air duct assembly, according to some embodiments.

FIG. 1 depicts an isometric view of a cylindrical air duct assembly 1. As shown, the air duct assembly 1 includes a first end 2, a second end 3, and interior wall 4, an exterior wall 5, and a control assembly 100. In some embodiments, the air duct assembly 1 can be situated such that air flows from the first end 2 to the second end 3. Air duct assembly 1 is further shown to include an air damper assembly 10 situated within the interior wall 4.

Figure 2:
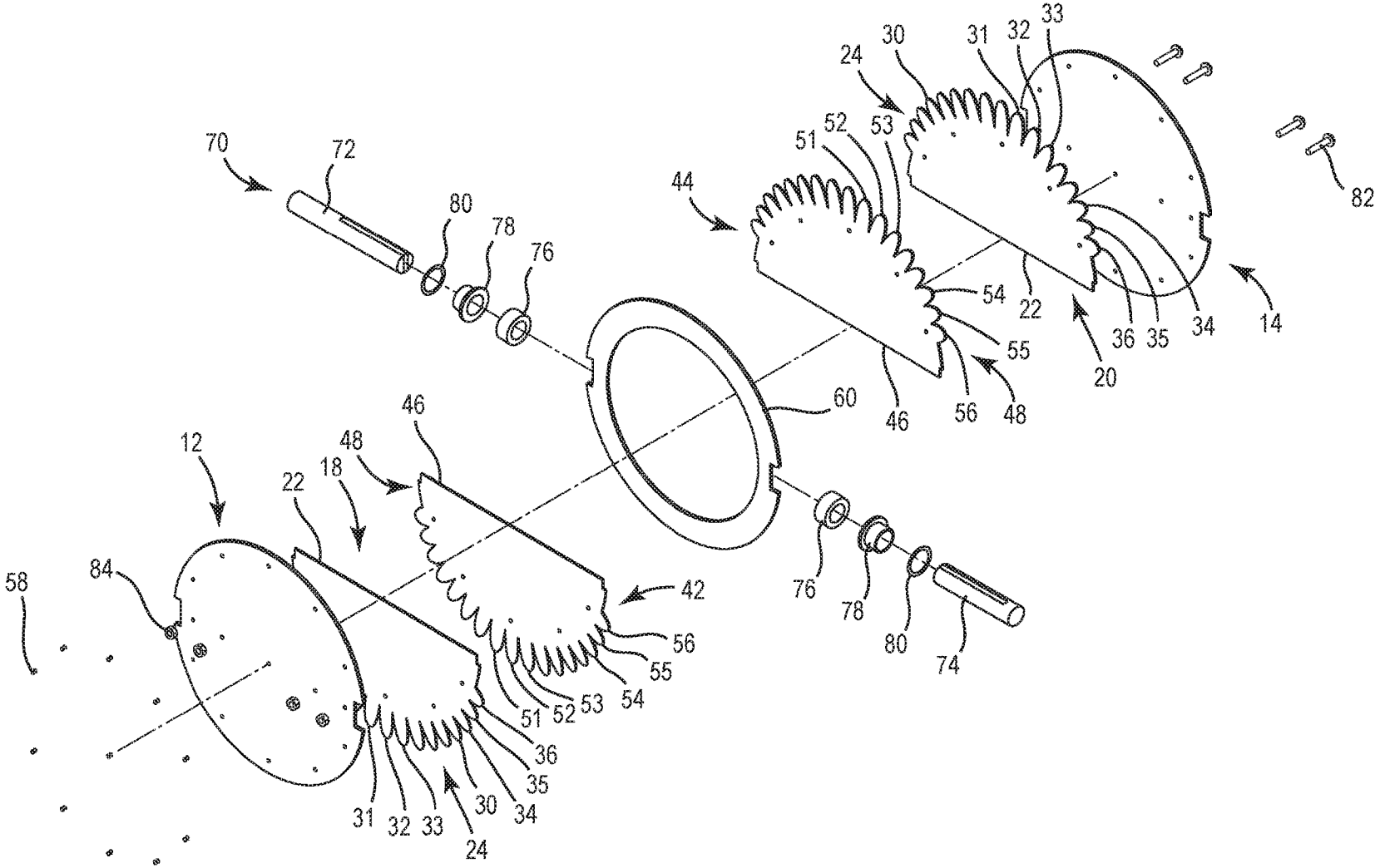
FIG. 2 is an exploded isometric view of an air damper assembly which can be used in the air duct assembly of FIG. 1, according to some embodiments.
Figure 5:
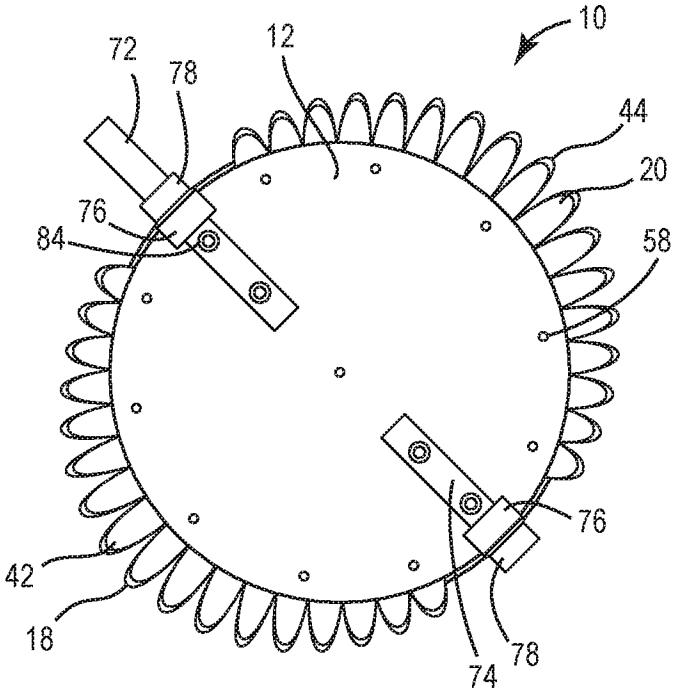
FIG. 5 is a rear elevation view of the air damper assembly of FIG. 2, according to some embodiments.
Figure 4:
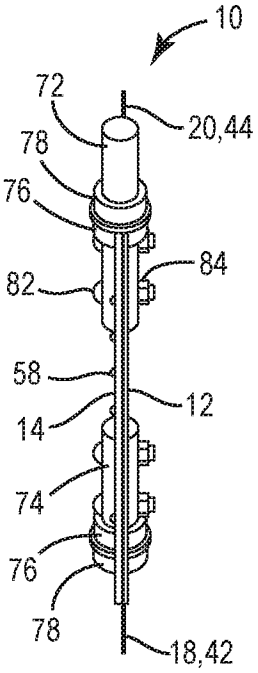
FIG. 4 is a side elevation view of the air damper assembly of FIG. 2, according to some embodiments.
Figure 3:
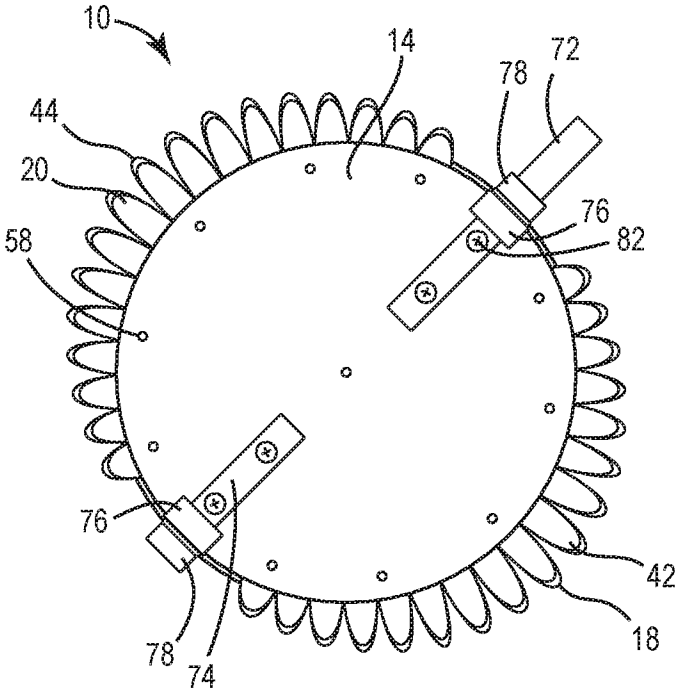
FIG. 3 is a front elevation view of the air damper assembly of FIG. 2, according to some embodiments.

Referring now to FIGS. 2-5, several views of the air damper assembly 10 are provided. FIG. 2 depicts an exploded isometric view, FIG. 3 depicts a front elevation view, FIG. 4 depicts a side elevation view, and FIG. 5 depicts a rear elevation view. Damper assembly 10 is shown to include, among other components, a first damper plate 12, and a second damper plate 14. A first airflow member comprises a first section 18 and a second section 20. In exemplary embodiments, the first and second sections 18, 20 are made of a generally rigid material, such as, but not limited to, metal, polymer, ceramic, wood, coated material, laminate, or the like. Each section comprises a straight portion 22 and a curved portion 24.

A plurality of fingers 30 is shown to extend outward from and at least partially around the curved peripheral portion of each section 18, 20. In one exemplary embodiment, the fingers 30 may be integrally formed with the sections 18, 20. In another exemplary embodiment, the fingers 30 may be separate and mounted or attached to at least a portion of each section 18, 20. In exemplary embodiments the fingers 30 are formed of a relatively resilient material. In exemplary embodiments, the material may be metal, resilient plastic, or other generally resilient material. In some embodiments, fingers 30 are made of metal or other resilient material which is covered or coated with plastic or other material that will not appreciably scratch the interior wall of the air duct. In other embodiments, fingers 30 are made of a single material that is both resilient and that will not appreciably scratch the interior wall of the air duct.

The fingers 30 may be sized to have a length smaller proximate to the straight portion 22 and increase in length proximate to the midpoint of the curved portion 24. Stated differently, in such exemplary embodiments, the length of the fingers 30 varies from a maximum to a minimum over a span of about 90 degrees around the periphery. For example, referring specifically to FIG. 2, fingers 31-33 (with finger 31 being longer than fingers 32 or 33) are longer than fingers 34-36 (with finger 34 being longer than fingers 35 or 36). In exemplary embodiments, the second section 20 of the airfoil member 16 is configured in mirror image to the first section 18 and has fingers 30 sized and configured similar to those associated with the first section 18.

The second airfoil member comprises, in exemplary embodiments, a first section 42 and a second section 44. In exemplary embodiments, the first and second sections 42, 44 are made of a generally rigid material, such as, but not limited to, metal (e.g., Aluminum), polymer, ceramic, wood, coated material, laminate, or the like. In some embodiments, the first and second sections 42, 44 are fabricated from different material as first and second sections 18, 20. For example, the first and second sections 42, 44 can be fabricated from a material of lower stiffness than the material of first and second sections 18, 20. In other embodiments, the first and second sections 42, 44 are fabricated from the same material as first and second sections 18, 20. Each section 42, 44 is shown to comprise a straight portion 46 and a curved portion 48.

A plurality of fingers 50 extends outward from and at least partially around the curved peripheral portion of each section 42, 44. In one exemplary embodiment, the fingers 50 may be integrally formed with sections 42, 44. In another exemplary embodiment, the fingers 50 may be separate and mounted or attached to at least a portion of each section 42, 44. In exemplary embodiments, the fingers 50 are formed of a material more flexible than the material forming the fingers 30. In exemplary embodiments, the material may be a flexible metal, plastic, fabric, laminate, or other material having a degree of flexion but which can return to the unflexed position. In one exemplary embodiment, the material may be polytetrafluorenthylene ("Teflon®). Similar to the fingers 30, in some embodiments, the fingers 50 are sized to have a length smaller proximate to the straight portion 46 and increase in length proximate to the midpoint of the curved portion 48. For example, fingers 51-53 (with finger 51 being longer than fingers 52 or 53) are longer than fingers 54-56 (with finger 54 being longer than fingers 55 or 56).

In exemplary embodiments, the second section 44 is configured in mirror image to the first section 42 and has fingers 50 sized and configured similar to those associated with the first section 42. In exemplary embodiments, the fingers 50 may be sized to be slightly longer and/or slightly larger than the corresponding matching adjacent fingers 30 (i.e., when the first and second airfoil members are assembled and the fingers 30 are generally adjacent to fingers 50, finger 31 is adjacent to finger 51). This may be done so that the resilient fingers 30 are close to, but not touching (or barely touching) the interior wall 4 of the air duct 1 when the damper 10 is in the closed position, which will avoid or reduce the likelihood of the interior wall 4 being scratched by the resilient fingers 30. In an alternative exemplary embodiment, the fingers 30 are slightly offset from the corresponding fingers 50.

The first and second damper plates 12, 14 may be connected to each other with the first and second airfoil members comprising sections 18, 20, 42, 44 sandwiched therebetween such that on one side of the damper the fingers 50 are showing on the top half and the fingers 30 are showing on the bottom half, with the reverse being the case on the other side of the damper. In some embodiments, the sections 18, 20, 42, 44 may be coupled with each other and the damper plates 12, 14 using rivets 58. In other embodiments, any other suitable fastening mechanism (e.g., bolts, screws, adhesives) can be utilized to couple the sections 18, 20, 42, 44 and the damper plates 12, 14. In some embodiments, the first and second damper plates 12, 14, may be connected to each other and the axle assembly 70 connected thereto using one or more bolts 82 and locknuts 84. It is to be understood that other fastening mechanisms known to those skilled in the air can be used.

In exemplary embodiments, an optional gasket 60 may be placed between the first and second damper plates 12, 14 and abutting the first and second sections 42, 44 of the second airfoil member (when assembled). The optional gasket 60 can be used to seal off the airflow through the air duct assembly 100. In various embodiments, the optional gasket can be fabricated from rubber, silicone, neoprene, a plastic polymer, or any other suitable gasket material.

The axle assembly 70 may comprise a single piece, or, in exemplary embodiments, may comprise a first member 72 and a second member 74. In exemplary embodiments, the first member 72 may be longer than the second member 74. As described in greater detail below with reference to FIG. 8, this may be because the first member 72 is configured to couple with a motor within the control assembly 100 of the air duct damper assembly 1. In some embodiments, each shaft member 72, 74 may comprise a split shaft sized to fit over the assembled first and second damper plates 12, 14 and first and second airfoil members, as shown in FIGS. 3-5. In other words, each shaft member 72, 74 can include a slot to receive the assembled damper plates 12, 14 and airfoil members. In exemplary embodiments, a rotation bushing 76 and a stationary bushing 78 may be fitted over each shaft member 72, 74 to ensure the free rotation of the air damper assembly 10 within the air duct assembly 1. In some embodiments, an O-ring 80 may also be fitted over each shaft member 72, 74.

Figure 6:
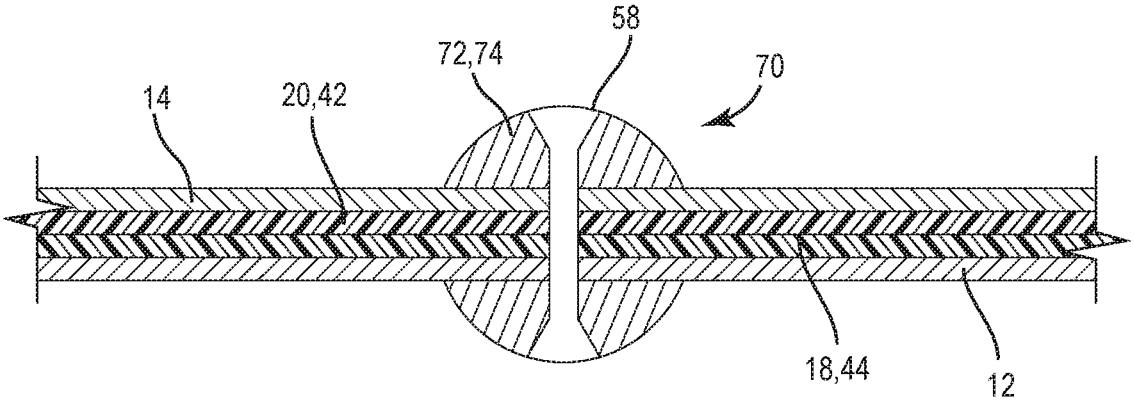
FIG. 6 is a side cross-sectional view of a shaft arrangement which can be used in the air damper assembly of FIG. 2, according to some embodiments.
Figure 7:
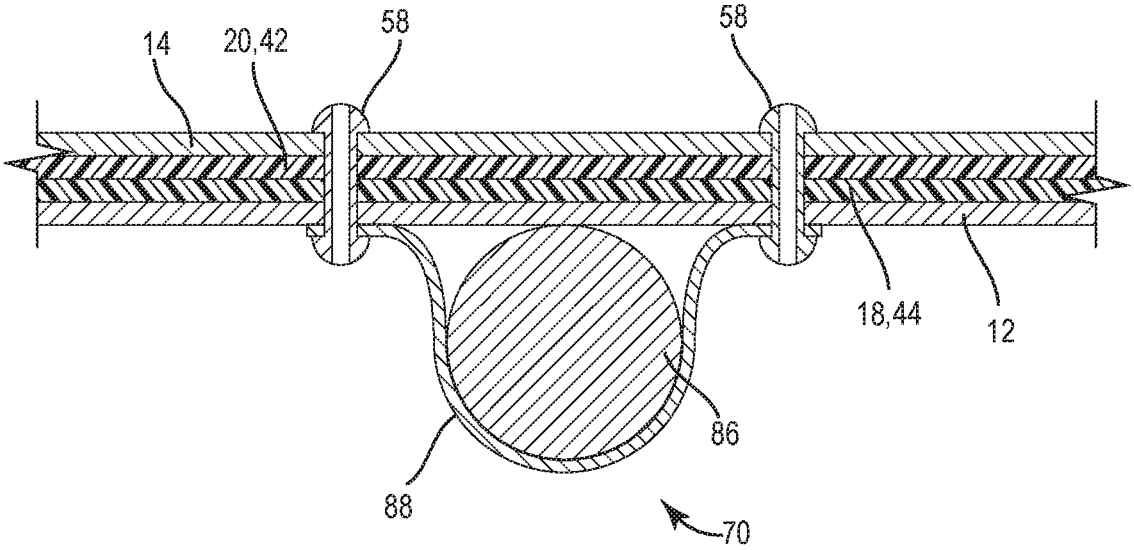
FIG. 7 is a side cross-sectional view of another shaft arrangement which can be used in the air damper assembly of FIG. 2, according to some embodiments.

Referring now to FIGS. 6 and 7, cross-sectional views of embodiments of the joint between the axle assembly 70, the damper plates 12, 14, and the sections 18, 20, 42, 44 are depicted. For example, as depicted in FIG. 6, the sections 18, 20, 42, and 44 can be retained between the damper plates 12 and 14 using split shaft members 72, 74. In various embodiments, rivets 58 passing through the split shaft members 72, 72 are used to fasten the split shaft members 72, 74 and retain the sections 18, 20, 42, and 44, and the damper plates 12 and 14 in a stacked configuration. In other embodiments, another type of fastener can be utilized instead of rivets 58.

Referring now to FIG. 7, an alternate joint embodiment is depicted. As shown, a solid shaft 88 may be used in the axle assembly 70 instead of split shaft members 72, 74. The solid shaft 88 may be retained on the stacked configuration of sections 18, 20, 42, 44 and damper plates 12, 14 using a U-bracket 88 and rivets 58. U-bracket 88 can have any suitable geometry required to retain the solid shaft 88 on the stacked configuration. In various embodiments, another type of fastener can be utilized instead of rivets 58. As shown, the solid shaft 88 can be coupled flush against the damper plate 12. In other embodiments, a symmetrical configuration may be utilized, and the solid shaft 88 can be coupled flush against the damper plate 14.

Figure 8:
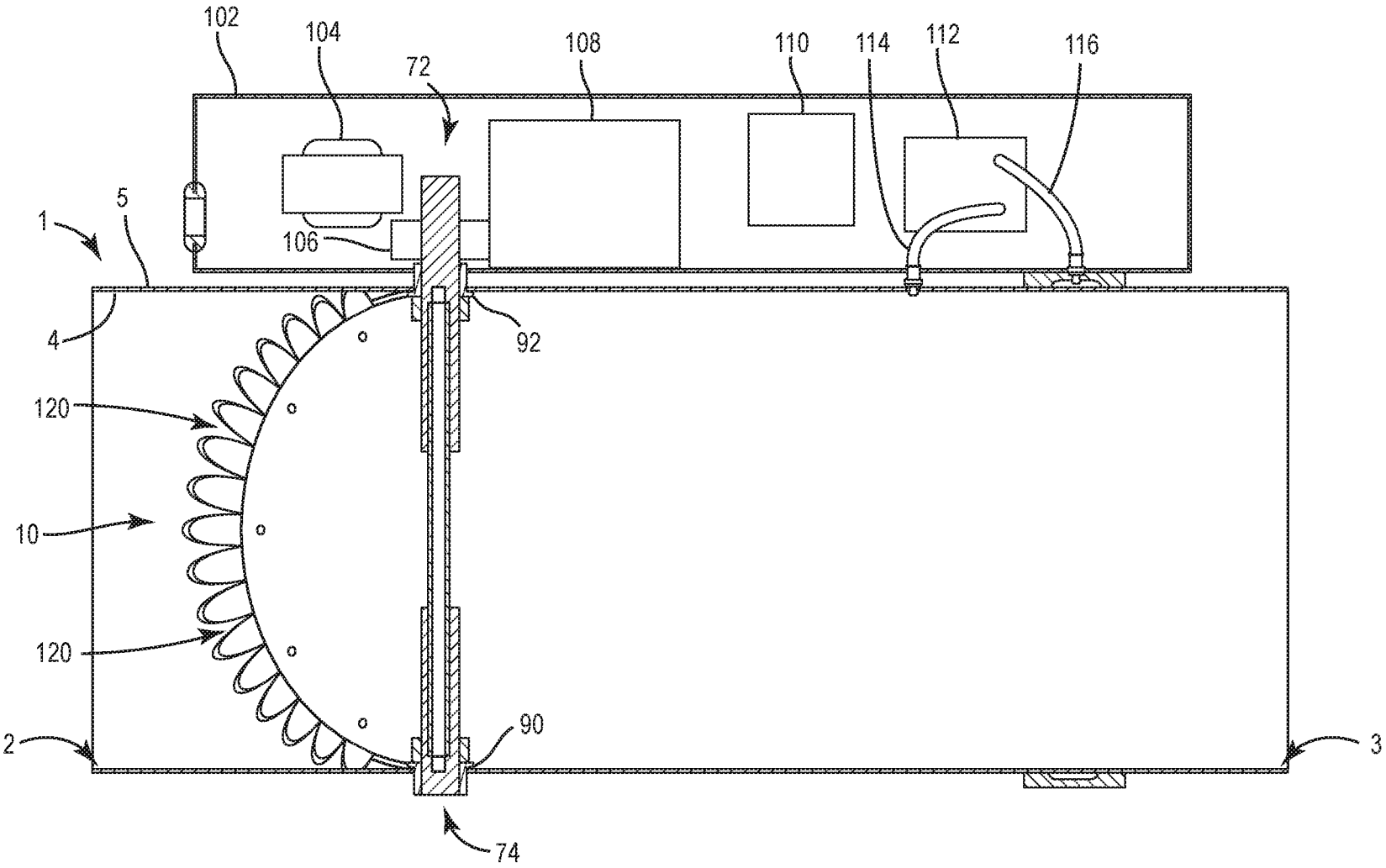
FIG. 8 is a side cross-sectional view of the air duct assembly of FIG. 1, according to some embodiments.

Referring now to FIG. 8, a side cross-sectional view of the damper assembly 10 mounted in the air duct assembly 1 is shown. The axle assembly shaft member 74 may be positioned in an aperture 90 situated at the bottom of the air duct, and shaft member 72 may be positioned within an aperture 92 situated at the top of the air duct, proximate the control assembly 100. The control assembly 100 may have a housing 102. The housing 102 may house a power supply 104, a gear/motor 106, an actuator 108, a control board 110, a pressure sensor 112, and a low pressure pickup 114, and a high pressure pickup 116. The pickups 114, 116 are in communication with pressure sensor mechanisms (not shown) inside the air duct 1, such mechanisms as are known to those skilled in the art.

In operation, an operator may provide a target airflow setpoint. Pressure sensor 112 may provide information on the current actual airflow calculated from a high pressure pickup 114 and a low pressure pickup 116. High pressure pickup 114 and low pressure pickup 116 can sense air pressure in the air duct flowing form the first end 2 to the second end 3 of the air duct 1. Movement of the damper 10 may occur to equalize the setpoint and actual airflow. Airflow setpoint signals and measured airflow signals may be received by the control board 110, which generates a position setpoint signal sent to the power supply 104, which in turn actuates the motor 106. The motor 106 is operationally associated with the axle assembly shaft member 72, causing it to rotate as needed between a fully opened position and a fully closed position.

Figure 9:
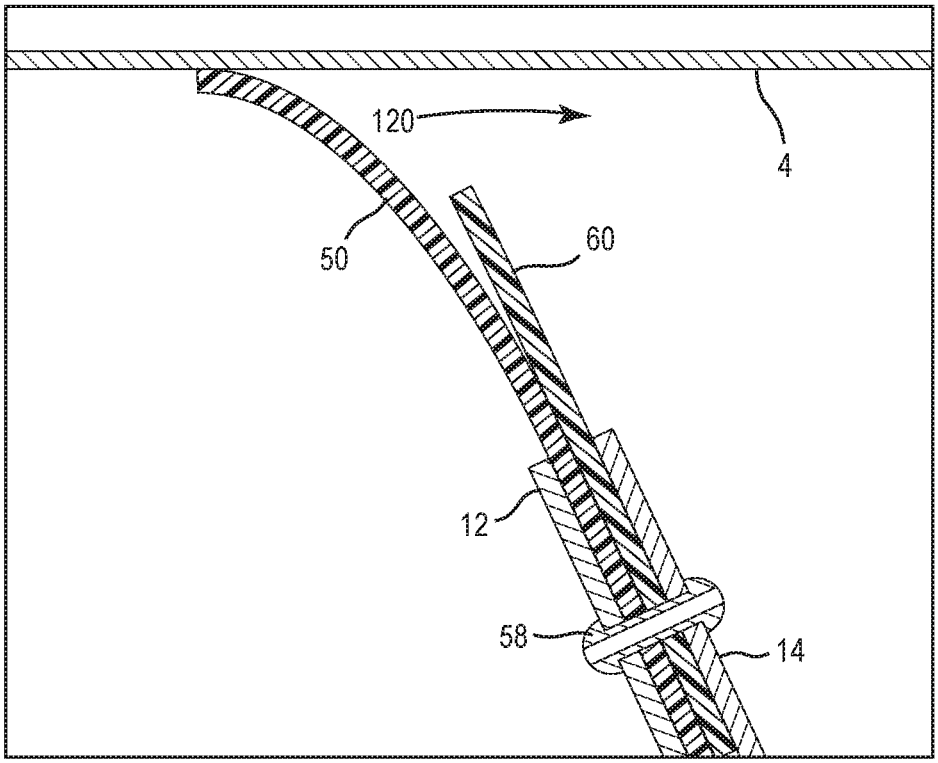
FIG. 9 is a detail cross-sectional view that depicts the air damper assembly of FIG. 2 in a partially closed position, according to some embodiments.
Figure 10:
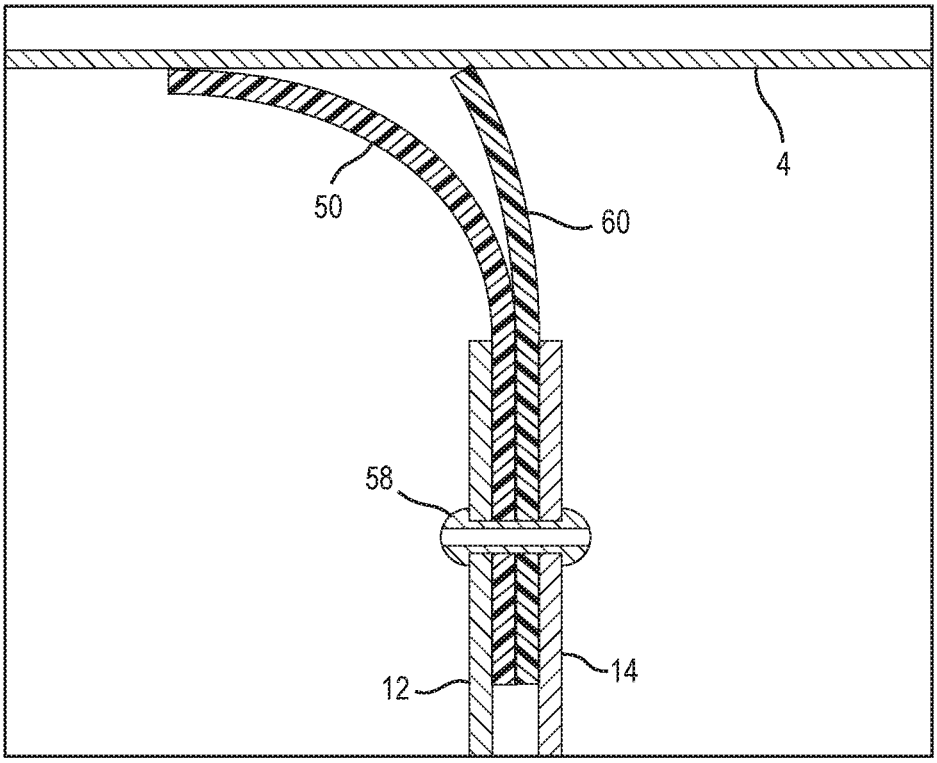
FIG. 10 is a detail cross-sectional view that depicts the air damper assembly of FIG. 2 in a fully closed position, according to some embodiments.

Referring now to FIGS. 9 and 10, detail cross-sectional views of the air damper assembly 10 are depicted in partially closed and fully closed positions, respectively. When the air damper assembly 10 rotates toward a closed position, as specifically depicted in FIG. 9, fingers 50 and gasket 60 come proximate to the interior wall 4. When doing so, the air flow is reduced, but not entirely. The airspace 120 between the fingers 50 permits air to flow through until the air damper 10 rotates into a fully closed position, in which event the fingers 50 (all or at least a portion thereof), can flex so that most of the length, or at least a portion of the flat surface, of the finger 50 contacts the interior wall 4, as shown in FIG. 10. The larger the portion of the finger 50 that contacts the interior wall 4, the smaller the airspace 120 and the smaller the amount of air that can flow through the damper.

A feature of the presently disclosed damper is that the airfoil members provide greater control and resolution of air pressure as the damper 10 and fingers 50, get closer to full closure. Because the present design does not need to accelerate air past vortex shedders (such as those used by a conventional damper product available from Accutrol™), higher flow rates can be obtained.

Figure 11:
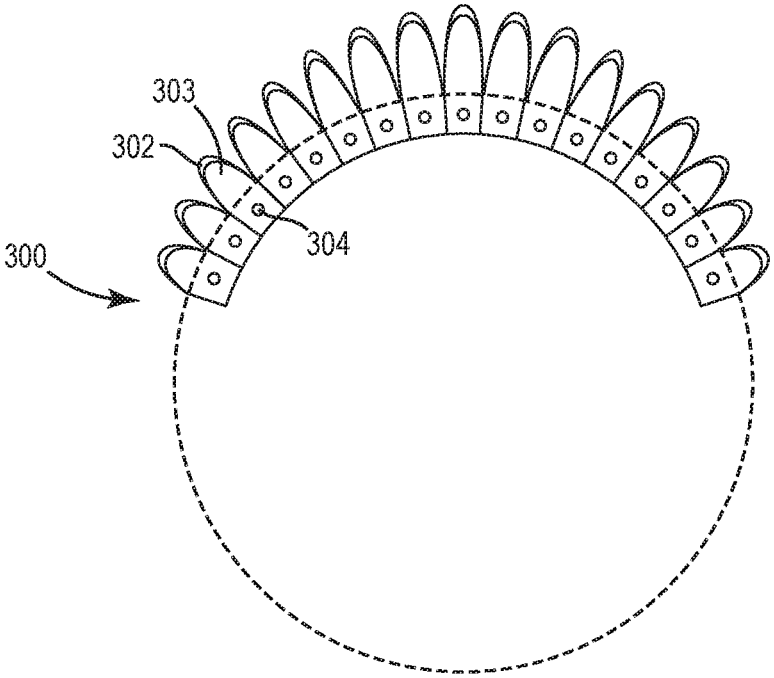
FIG. 11 is front elevation view of another air damper assembly which can be used in the air duct assembly of FIG. 1, according to some embodiments.
Figure 12:
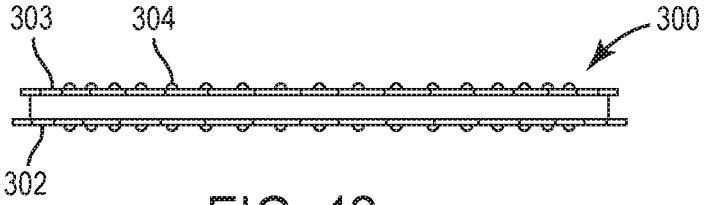
FIG. 12 is side elevation view of the air damper assembly of FIG. 11, according to some embodiments.
Figure 13:
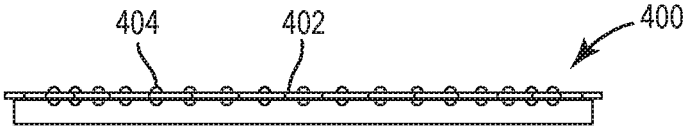
FIG. 13 is a side elevation view of another air damper assembly that can be used in the air duct assembly of FIG. 1, according to some embodiments.

Referring now to FIGS. 11 and 12, another embodiment of an air damper assembly 300 is depicted. Air damper assembly 300 can include a single plate, as opposed to the first and second damper plates of air damper assembly 100 as described above. Damper assembly 300 can have two rows of fingers 302, 303 attached to the periphery of the damper assembly 300 by fasteners 304. In another exemplary embodiment depicted in FIG. 13, an air damper assembly 400 can have a single row of a plurality of fingers 402 attached to the periphery of the damper assembly 400 by fasteners 404.

Figure 14:
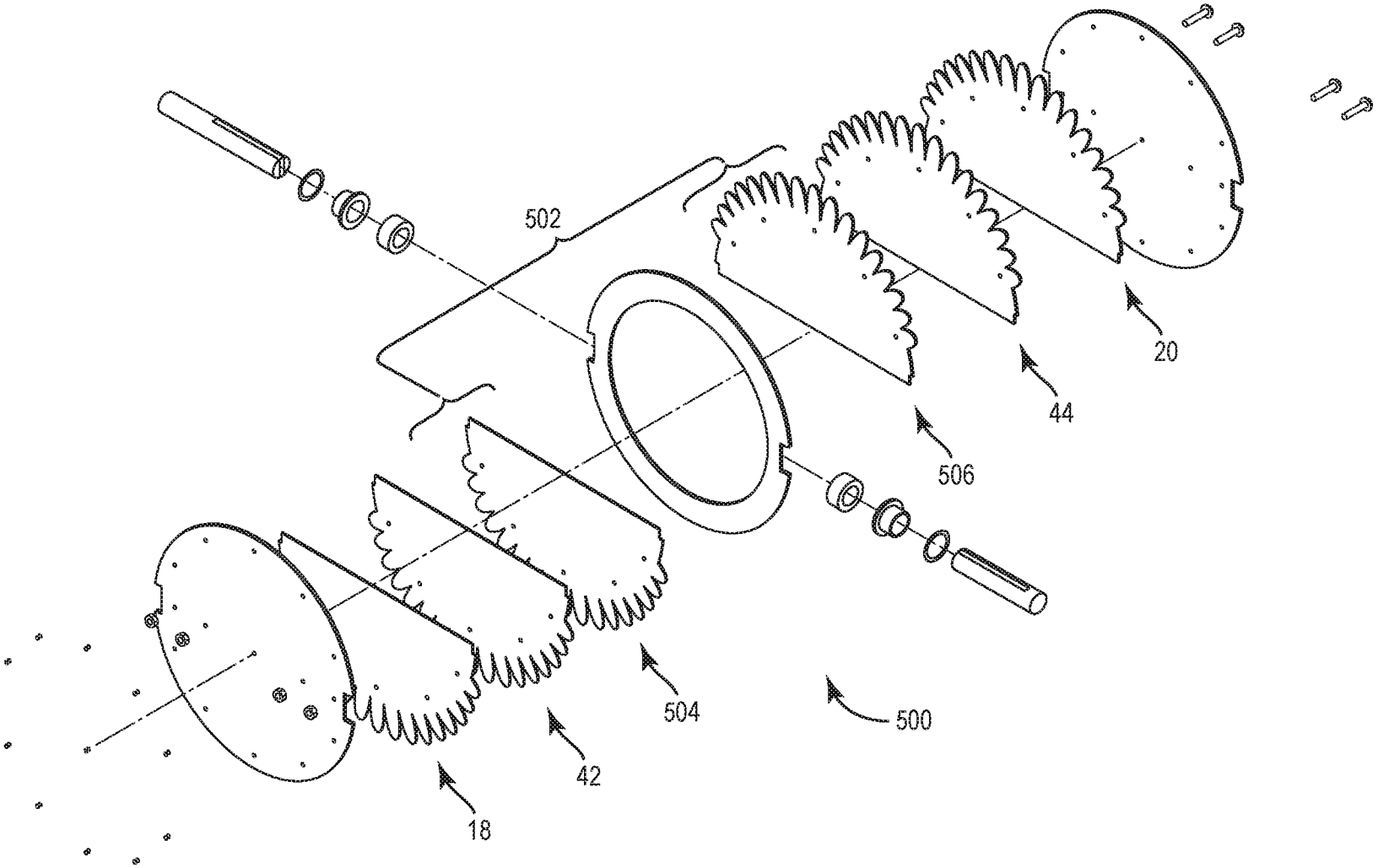
FIG. 14 is an exploded isometric view of another air damper assembly which can be used in the air duct assembly of FIG. 1, according to some embodiments.

In another alternative embodiment, the damper can have more than two rows of fingers. In one such embodiment, depicted in FIG. 14, a damper 500 is shown having three rows of fingers. The three rows of fingers can be achieved by incorporating a first airfoil (comprised of first section 18 and second section 20), a second airfoil (comprised of first section 42 and second section 44), and a third airfoil 502, comprised of first section 504 and second section 506. In some embodiments, the fingers of sections 504 and 506 of the third airfoil 502 have greater stiffness than the fingers of sections 18, 20, 42, 44. In other embodiments, one or more of sections 18, 20, 42, and 44 have greater or equivalent stiffness to sections 504 and 506.

Figure 15:
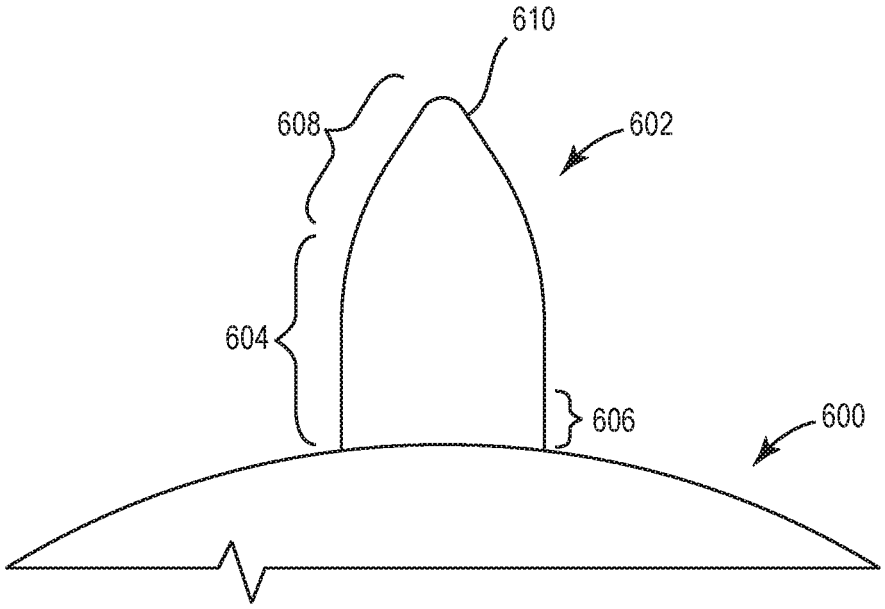
FIG. 15 is a detail view of another air damper assembly which can be used in the air duct assembly of FIG. 1, according to some embodiments.

Referring now to FIG. 15, a detail view of another embodiment of an air damper assembly 600 is depicted. Air damper assembly 600 can include teeth fabricated from one or more materials with varying stiffness. For example, each tooth 602 may have a relatively resilient or stiff portion 604 proximate to the base 606 and a relatively flexible portion 608 proximate to the distal end 610 of the tooth 600.

The above description of exemplary embodiments of a damper may be for use in an air duct. It is to be understood that the damper of the present disclosure can also be used with a duct constructed for conveyance of other fluids, such as, but not limited to, gases and liquids.

The present invention also relates to a damping system comprising a duct, a damper according to the damper embodiments disclosed hereinabove and mounted in the duct, and a control assembly adapted to rotate the damper from an open to a closed position.

As used in the specification and the appended claims, the singular forms "a," "an" and "the" include plural referents unless the context clearly dictates otherwise.

"Optional" or "optionally" means that the subsequently described event or circumstance may or may not occur, and that the description includes instances where said event or circumstances occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc., of these components are disclosed that while specific reference of each various individual and collective combinations and permutation of these may not be explicitly disclosed, each is specifically contemplated and described herein, for all methods, equipment and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

It should further be noted that any patents, applications and publications referred to herein are incorporated by reference in their entirety.

What is claimed is:

1. An air damper assembly for an air duct, the air duct having an interior wall, the air damper assembly comprising:

an airflow member having a first peripheral edge;

a plurality of flexible projections spaced at least partially around and extending from the first peripheral edge, the plurality of flexible projections providing a plurality of airspaces between adjacent ones of the plurality of flexible projections at least partially around the first peripheral edge;

a gasket having a second peripheral edge;

an axle assembly rotatably coupled to the air duct such that rotation of the axle assembly causes the airflow member to rotate within the air duct between a fully open position and a fully closed position to control a flow of a fluid through the air duct; and a first damper plate having a third peripheral edge disposed radially inward from the second peripheral edge;

wherein the axle assembly is coupled to the first damper plate; and wherein the plurality of flexible projections flex during rotation of the airflow member between the fully closed position and a partially closed position such that a size of one of the plurality of airspaces varies to control a portion of the flow of the fluid through the air duct.

2. The air damper assembly of claim 1, wherein:

each of the plurality of flexible projections is made of a first material;

the airflow member comprises:

a first airfoil member having the plurality of flexible projections, and a second airfoil member having a plurality of second projections made of a second material, the second material having a greater stiffness than the first material; and at least one of:

at least a portion of the second airfoil member extends over at least a portion of the first airfoil member, or at least a portion of the first airfoil member extends over at least a portion of the second airfoil member.

3. The air damper assembly of claim 2, further comprising a third airfoil member having a plurality of third projections made of a third material, the third material having a greater stiffness than the second material.

4. The air damper assembly of claim 1, wherein each of the plurality of flexible projections includes a resilient portion proximate the first peripheral edge and a flexible portion, the resilient portion having a greater stiffness than the flexible portion.

5. The air damper assembly of claim 1, wherein the gasket is configured to contact the interior wall of the air duct when the airflow member is in the fully closed position.

6. The air damper assembly of claim 1, wherein at least a portion of each of the plurality of flexible projections is configured to contact the interior wall of the air duct when the airflow member is in the fully closed position.

7. The air damper assembly of claim 1, wherein at least a portion of each of the plurality of flexible projections is configured to contact the interior wall of the air duct when the airflow member is in the partially closed position.

8. The air damper assembly of claim 1, wherein at least a portion of each of the plurality of flexible projections is fabricated from a polymer.

9. The air damper assembly of claim 1, wherein at least a portion of each of the plurality of flexible projections is fabricated from a metal having a plastic coating.

10. The air damper assembly of claim 1, further comprising a second damper plate coupled to the first damper plate;

wherein the airflow member is coupled to at least one of the first damper plate or the second damper plate; and wherein at least a portion of the airflow member is disposed between the first damper plate and the second damper plate.

11. The air damper assembly of claim 1, wherein the axle assembly comprises a shaft member configured to be fastened to the damper plate using a bracket component and a plurality of rivets.

12. The air damper assembly of claim 1, further comprising a damper control assembly configured to drive rotation of the axle assembly.

13. The air damper assembly of claim 12, wherein the damper control assembly comprises a pressure sensor, a motor, and an actuator.

14. The air damper assembly of claim 1, wherein at least one of the plurality of flexible projections is made of polymer.

15. The air damper assembly of claim 1, wherein:

a first flexible projection of the plurality of flexible projections is centered on a first axis; and a second flexible projection of the plurality of flexible projections is centered on a second axis that is angularly offset from the first axis.

16. A method of controlling a flow of fluid through an air duct, the method comprising:

receiving a target airflow setpoint;

receiving an airflow measurement from a pressure sensor;

generating a command to rotate an airflow member about an axis to a position setpoint between a fully open position and a fully closed position based at least in part on the target airflow setpoint and the airflow measurement, wherein the airflow member has a first peripheral edge and a plurality of projections spaced at least partially around and extending from the first peripheral edge, the plurality of projections increasing in length from the first peripheral edge at increasing distances from the axis, wherein the airflow member is coupled to a damper plate having a second peripheral edge, wherein a gasket is placed on the damper plate, the gasket having a third peripheral edge disposed radially outward from the second peripheral edge; and driving the airflow member to the position setpoint.

17. The method of claim 16, wherein at least a portion of each of the plurality of projections is configured to contact an interior wall of the air duct when the airflow member is in the fully closed position.

18. The method of claim 16, wherein at least a portion of each of the plurality of projections is configured to contact an interior wall of the air duct when the airflow member is in a partially closed position.

19. The method of claim 16, wherein:

each of the plurality of projections is made of a first material;

the airflow member comprises:

a first airfoil member having the plurality of projections, and a second airfoil member having a plurality of second projections made of a second material, the second material having a greater stiffness than the first material; and at least one of:

at least a portion of the second airfoil member extends over at least a portion of the first airfoil member, or at least a portion of the first airfoil member extends over at least a portion of the second airfoil member.

20. The method of claim 19, wherein the airflow member further comprises a third airfoil member having a plurality of third projections made of a third material, the third material having a greater stiffness than the second material.

21. The method of claim 16, wherein each of the plurality of projections includes a resilient portion proximate the first peripheral edge and a flexible portion, the resilient portion having a greater stiffness than the flexible portion.

22. The method of claim 16, wherein at least one of the plurality of projections is made of polymer.

23. A method of providing an air damper assembly for an air duct, the air duct having an interior wall, comprising:

providing an airflow member having a first peripheral edge;

providing a damper plate having a second peripheral edge, the damper plate coupled to the airflow member;

providing a gasket having a third peripheral edge disposed radially outward from the second peripheral edge;

providing a plurality of projections between the airflow member and the air duct, the plurality of projections extending from the first peripheral edge and gradually increasing in length from a minimum to a maximum, the length being from the first peripheral edge; and providing an axle assembly fixedly coupled to the damper plate and rotatably coupled to the air duct such that rotation of the axle assembly about an axis causes the airflow member to rotate within the air duct and increase or decrease fluid flow therethrough;

wherein a first projection of the plurality of projections has a length equal to the minimum is disposed adjacent the axis.

* * * * *